US007988487B2

(12) United States Patent
Nomiyama et al.

(10) Patent No.: US 7,988,487 B2
(45) Date of Patent: Aug. 2, 2011

(54) CONNECTOR

(75) Inventors: Toru Nomiyama, Tokyo (JP); Masafumi Kodera, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/924,855

(22) Filed: Oct. 6, 2010

(65) Prior Publication Data

US 2011/0092107 A1 Apr. 21, 2011

(30) Foreign Application Priority Data

Oct. 20, 2009 (JP) ..... 2009-241269

(51) Int. Cl.
*H01R 13/73* (2006.01)

(52) U.S. Cl. ..... 439/541.5

(58) Field of Classification Search ..... 439/660, 439/607.23–607.25
See application file for complete search history.

(56) References Cited

U.S. PATENT DOCUMENTS

| | | | | |
|---|---|---|---|---|
| 6,835,091 | B2 | 12/2004 | Oleynick et al. | |
| 6,935,870 | B2 * | 8/2005 | Kato et al. | 439/108 |
| 7,303,410 | B2 * | 12/2007 | Saito | 439/108 |
| 7,559,805 | B1 * | 7/2009 | Yi et al. | 439/660 |

FOREIGN PATENT DOCUMENTS

JP 2003-068407 3/2003

* cited by examiner

*Primary Examiner* — Phuong Dinh
(74) *Attorney, Agent, or Firm* — Collard & Roe, P.C.

(57) ABSTRACT

A number of the terminal rows RT1 to RT3 are minimized, as compared to a number of the connect rows RC1 to RC4. In the terminal row RT1, the terminal portions 304 of the signal contact pair C22, C23 are arranged between the terminal portions 304 of the signal contact pair C11, C12 and the terminal portions 304 of the signal contact pair C14, C15. In the terminal row RT3, the terminal portions 304 of the signal contact pair C42, C43 are arranged between the terminal portions 304 of the signal contact pair C31, C32 and the terminal portions 304 of the signal contact pair C34, C35. Thus, a size of the footprint of the connector 100 can be reduced, and cross talks between the signal contact pair C11, C12 and the signal contact pair C14, C15 and between the signal contact pair C31, C32 and the signal contact pair C34, C35 can be reduced.

8 Claims, 10 Drawing Sheets

CONNECTOR

CROSS REFERENCE TO RELATED APPLICATIONS

Applicant claims priority under 35 U.S.C. §119 of Japanese Patent Application No. JP2009-241269 filed Oct. 20, 2009.

BACKGROUND OF THE INVENTION

The present invention relates to a connector comprising a plurality of contact sets and, in particular, to an USB (Universal Serial Bus) 3.0 Standard-A receptacle connector comprising at least two sockets.

JP-A 2003-68407 discloses a double-stacked USB 2.0 connector which has a minimized footprint, the contents of JP-A 2003-68407 being incorporated herein by reference in their entirety.

However, the connector of JP-A 2003-68407 has a degraded signal transmission quality.

SUMMARY OF THE INVENTION

It is therefore an object of the present invention to provide a connector which has a reduced footprint without degradation of a signal transmission quality.

One aspect of the present invention provides a connector comprising a housing and a first contact set to a fourth contact set held by the housing. Each of the first contact set to the fourth contact set comprises a plurality of contacts. Each of the contacts has a connect portion and a terminal portion extending from the connect portion so that the contact has an L-like shape. The connect portion is configured to be connected to a mating connector. The terminal portion is configured to be connected to a connection object. The connect portions of the first contact set to the fourth contact set are arranged in first connect row to fourth connect row, respectively. The terminal portions of the first contact set to the fourth contact set are arranged in first terminal row to third terminal row. The contacts of the first contact set include two first signal contact pairs. The terminal portions of one of the first signal contact pairs and the terminal portions of another one of the first signal contact pairs are arranged apart from each other in the first terminal row. The contacts of the third contact set include two third signal contact pairs. The terminal portions of one of the third signal contact pairs and the terminal portions of another one of the third signal contact pairs are arranged apart from each other in the third terminal row.

An appreciation of the objectives of the present invention and a more complete understanding of its structure may be had by studying the following description of the preferred embodiment and by referring to the accompanying drawings.

Figure 1:
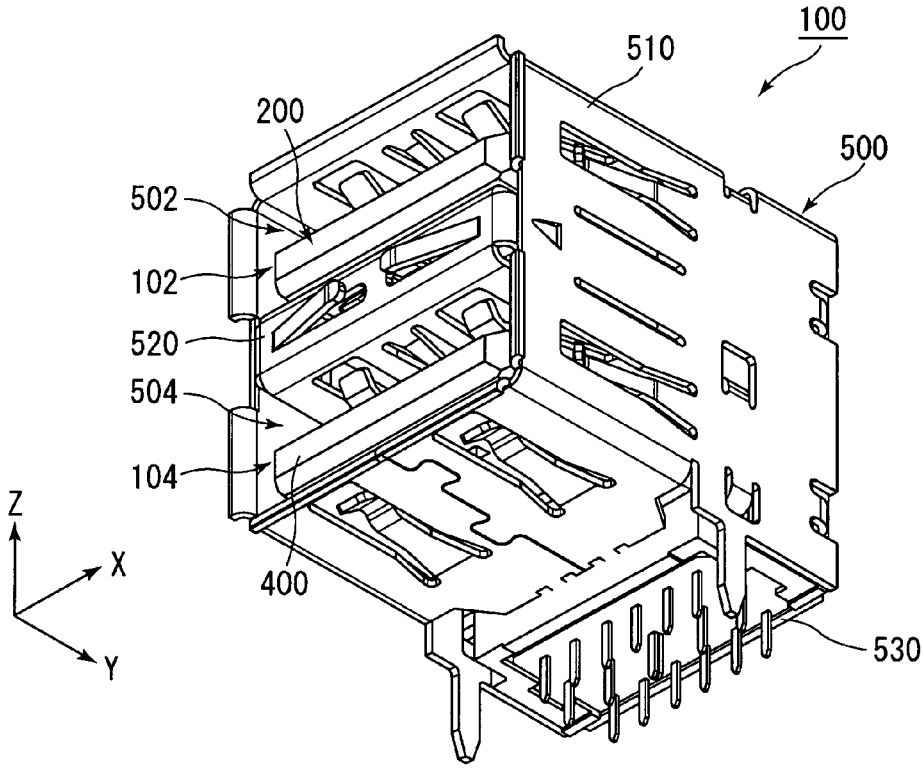
FIG. 1 is an oblique view showing bottom of a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A connector according to an embodiment of the present invention is a double-stacked USB (Universal Serial Bus) 3.0 Standard-A receptacle connector (i.e. an USB 3.0 Standard-A receptacle connector having two sockets).

Besides four contacts that are required for USB 2.0, the USB 3.0 Standard-A receptacle connector includes five more contacts. Contact portions of the five contacts are located towards the front of the connector, while those of the four contacts are located towards the back of the connector. In other words, the USB 3.0 Standard-A receptacle connector has a two-row (two-tier) contact system. Accordingly, the double-stacked USB 3.0 Standard-A receptacle connector has a four-row contact system.

Figure 2:
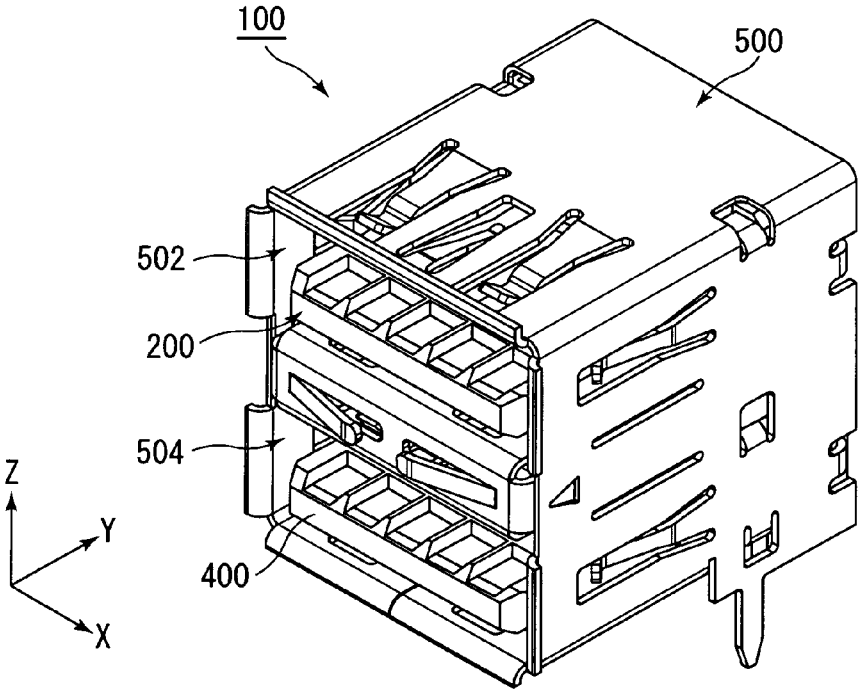
FIG. 2 is an oblique view showing top of the connector of FIG. 1.
Figure 3:
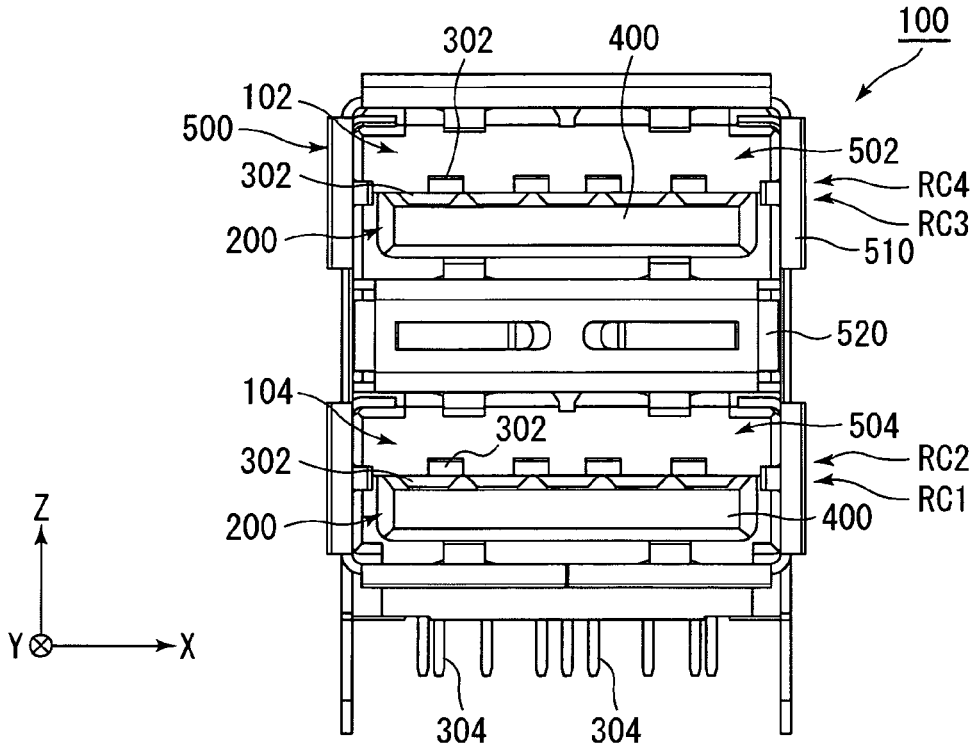
FIG. 3 is a front view showing the connector of FIG. 1.

With reference to FIGS. 1 to 3, the connector 100 comprises two sockets 102 and 104 which are receivable USB 3.0 Standard-A plug connectors, respectively, along the Y-direction. The connector 100 is configured to be installed on a circuit board (a connection object: not shown). As shown in FIG. 3, the sockets 102 and 104 are arranged in the Z-direction. As understood from FIGS. 1 to 4, the connector 100 of the embodiment is a right angle connector. In other words, a front portion of the connector 100 is matable with the mating plug connector along the Y-direction, while a bottom portion of the connector 100 is mountable on the circuit board.

With reference to FIGS. 1 to 3, the connector 100 comprises a structure 200 and a shell 500 covering the structure 200. The shell 500 comprises two opening portions 502 and 504 positioned on the front portion of the connector 100. The sockets 102 and 104 are positioned within the opening portion 502 and 504, respectively. The opening portions 502 and 504 define openings of the sockets 102 and 104, respectively.

With reference to FIGS. 1, 2, 5, 7, 9 and 11, the structure 200 comprises a first assembly 210 to a fourth assembly 240, being stacked in numeral order along the Z-direction.

Figure 5:
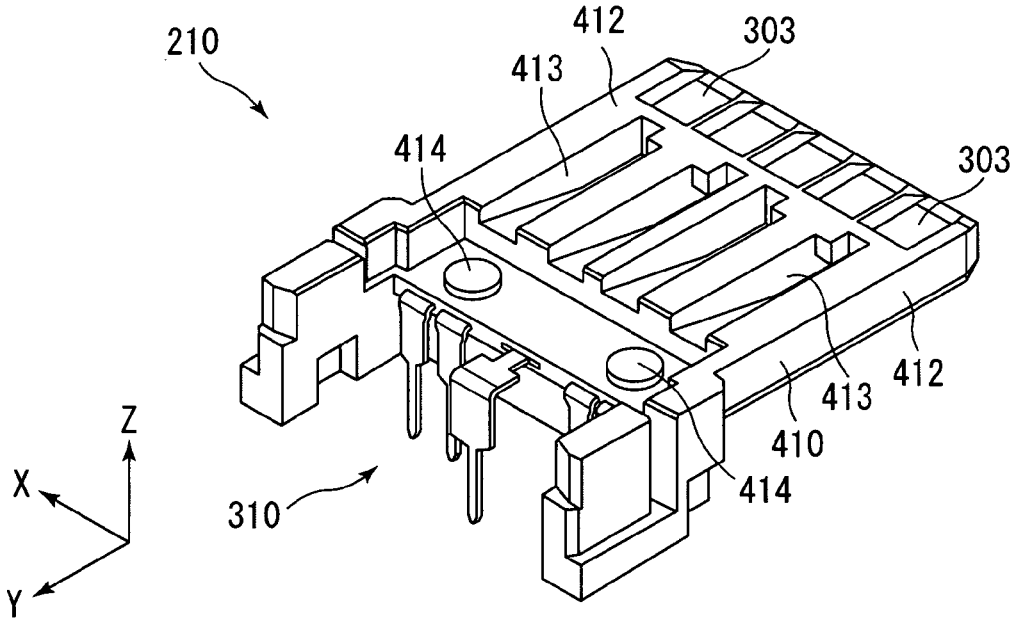
FIG. 5 is an oblique view showing a first assembly included in the connector of FIG. 1.
Figure 6:
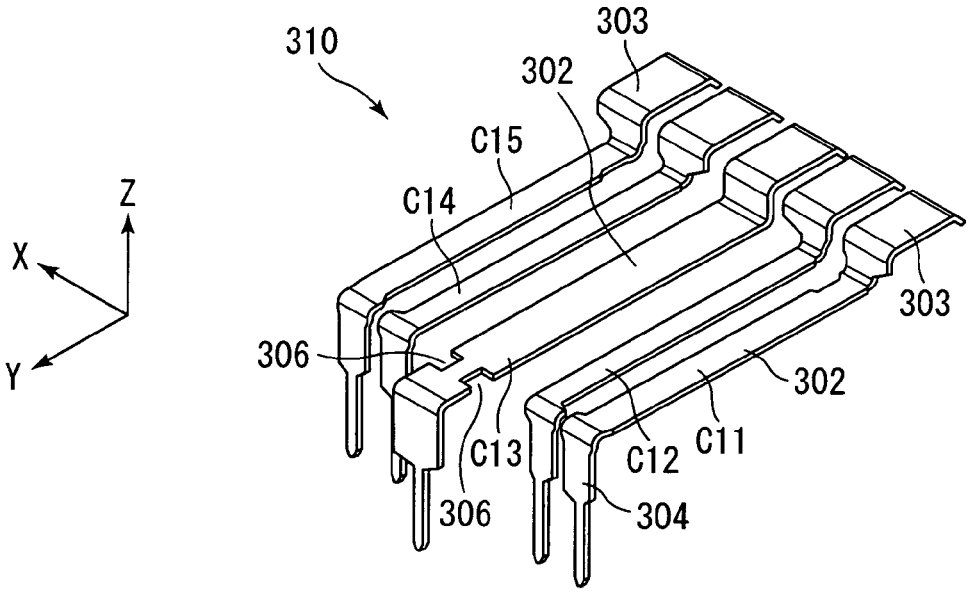
FIG. 6 is an oblique view showing a first contact set included in the first assembly of FIG. 5.

With reference to FIGS. 5 and 6, the first assembly 210 comprises a first contact set 310 and a first retainer 410 retaining the first contact set 310. The first retainer 410 is formed of an insulator.

With reference to FIG. 6, the first contact set 310 comprises five contacts C11 to C15 required only for the USB 3.0 connection. The contacts C11, C12, C14 and C15 are signal contacts. The contact C13 is a ground contact. The contacts C11 and C12 constitute a signal contact pair, and the contacts C14 and C15 constitute another signal contact pair. The ground contact C13 is arranged between the signal contact pair C11 and C12 and the signal contact pair C14 and C15 in an X-direction, i.e. in a width direction of the socket 104, as shown in FIG. 3. Each of the contacts C11 to C15 has a connect portion 302 extending along the Y-direction and a terminal portion 304 extending from the connect portion 302 along the Z-direction so that each of the contacts C11 to C15 has an L-like shape. The connect portion 302 has a contact portion 303. The contact portion 303 is configured to be brought into contact with a contact of the mating plug connector. The terminal portion 304 is configured to be connected to the circuit board.

The connect portion 302 of the ground contact C13 has a narrow part 306. The narrow part 306 is formed with two notches (two rectangular cuts), in opposite edges in the X-direction of the connect portion 302. As shown in FIGS. 5 and 6, the narrow part 306 and the terminal portions 304 of the signal contacts C11, C12, C14 and C15 are arranged in the same position in the Y-direction. In other words, when seen along the Z-direction, the narrow part 306 and the terminal portions 304 of the signal contacts C11, C12, C14, and C15 are arranged on a straight line extending along the X-direction.

Figure 14:
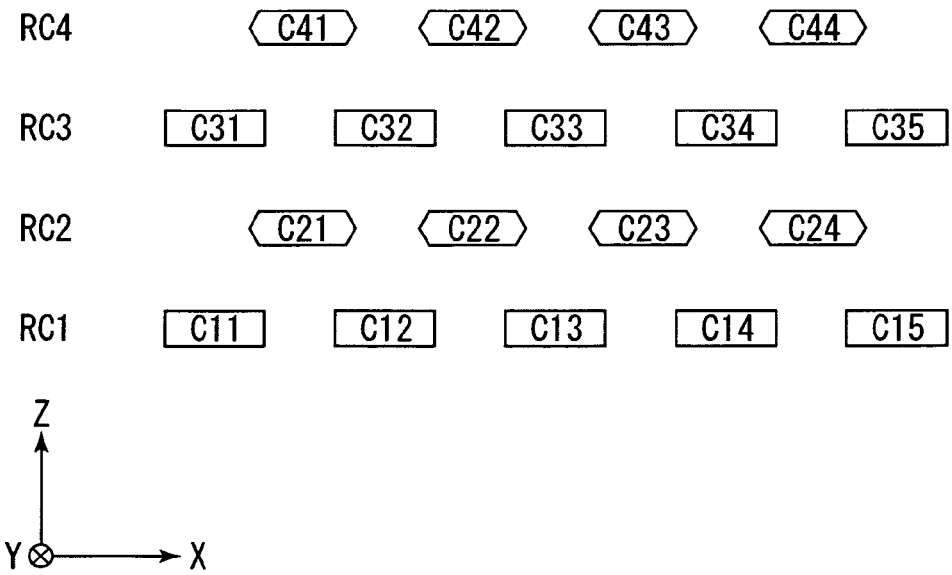
FIG. 14 is a schematic view showing an arrangement of connect portions of the first contact set to the fourth contact set of FIGS. 6, 8, 10 and 12, respectively.
Figure 15:
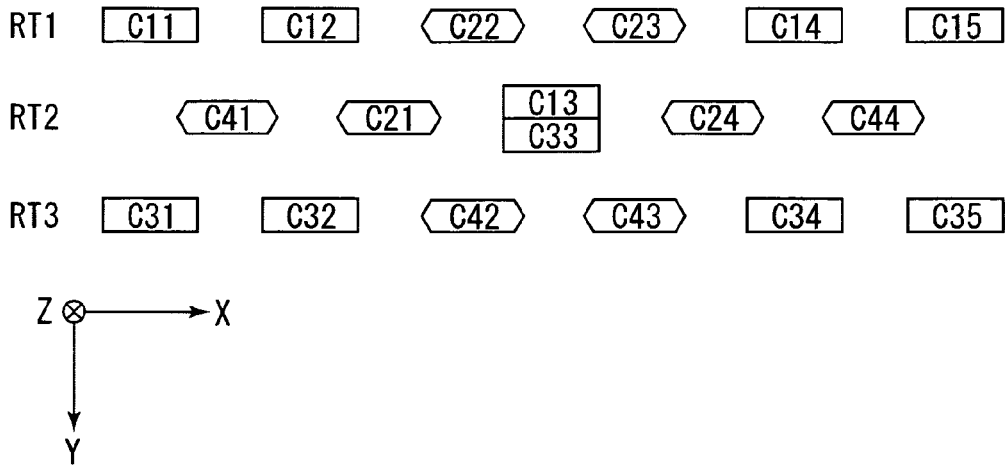
FIG. 15 is a schematic view showing an arrangement of terminal portions of the first contact set to the fourth contact set of FIGS. 6, 8, 10 and 12, respectively.

With reference to FIGS. 5 and 6, the first retainer 410 comprises a base portion 412 having a plate-like shape, four grooves 413 formed on the base portion 412 and positioning portions 414 formed on a top side and a bottom side (not shown) of the base portion 412. The base portion 412 has a front end in the Y-direction. The base portion 412 retains the connect portions 302 of the contacts C11 to C15 so that the contact portions 303 of the connect portions 302 are arranged close to the front end of the base portion 412. As clearly understood from FIG. 6, the connect portions 302 of the contacts C11 to C15 of the first contact set 310 are arranged in a common row, i.e. a first connect row RC1 as shown in FIG. 14. The terminal portions 304 of the signal contacts C11, C12, C14, and C15 are arranged in a first terminal row RT1, while the terminal portion 304 of the ground contact C13 is arranged in a second terminal row RT2, as shown in FIG. 15. In other words, the terminal portions 304 of the signal contacts C11, C12, C14 and C15 and the terminal portion 304 of the ground contact C13 are arranged in different rows.

As shown in FIG. 5, the positioning portions 414 protrude from the base portion 412, and are used as guides for stacking the second assembly 220 to the first assembly 210, as explained later.

Figure 7:
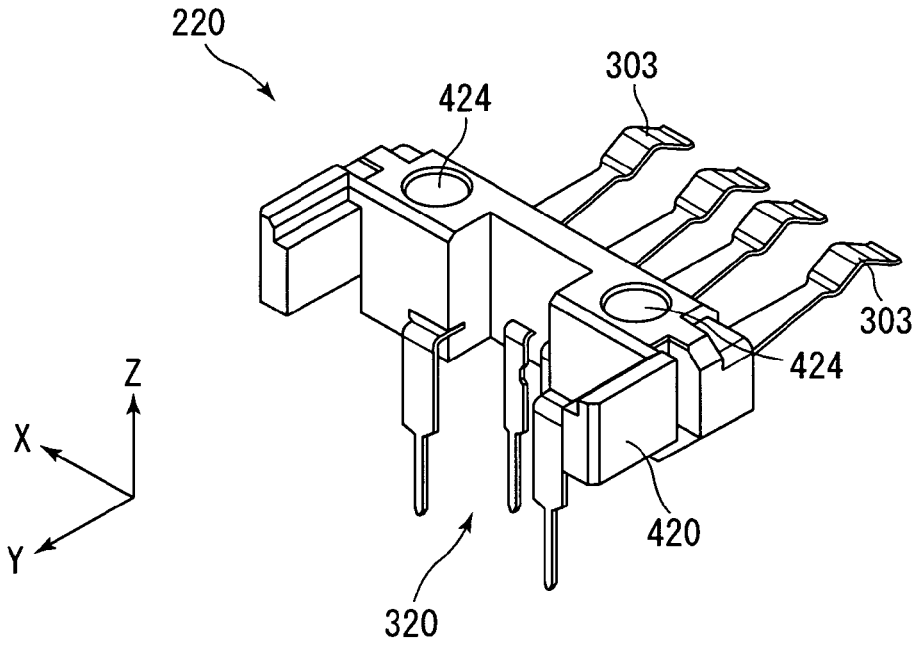
FIG. 7 is an oblique view showing a second assembly included in the connector of FIG. 1.
Figure 8:
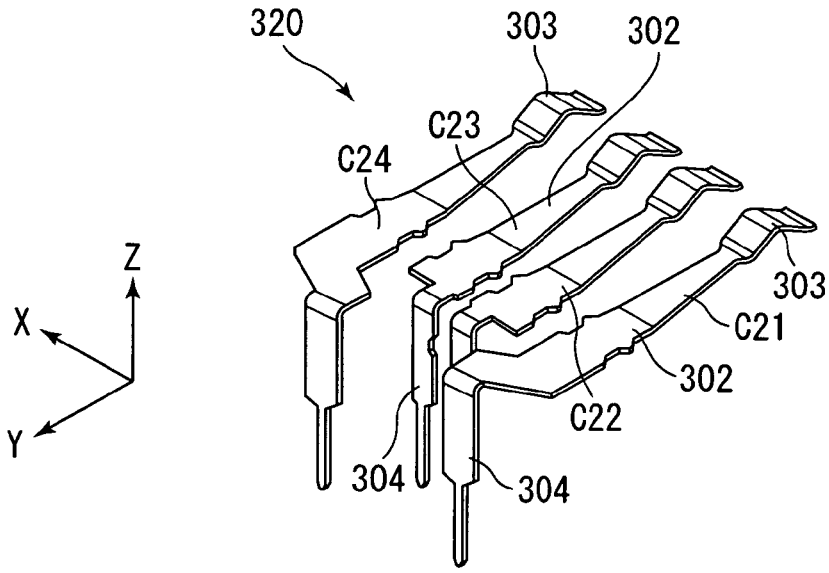
FIG. 8 is an oblique view showing a second contact set included in the second assembly of FIG. 7.

With reference to FIGS. 7 and 8, the second assembly 220 comprises a second contact set 320 and a second retainer 420 retaining the second contact set 320. The second retainer 420 is formed of an insulator.

With reference to FIG. 8, the second contact set 320 comprises four contacts C21 to C24 used for both USB 2.0 connection and USB3.0 connection. The contacts C22 and C23 are signal contacts and constitute a signal contact pair. The contact C21 is a ground contact. The contact C24 is a power contact. The signal contact pair C22 and C23 is arranged between the ground contact C21 and the power contact C24 in the X-direction. Similarly to the first contact set 310 as shown in FIG. 6, each of the contacts C21 to C24 has a terminal portion 304 and a connect portion 302 having a contact portion 303.

With reference to FIGS. 7 and 8, the second retainer 420 comprises positioning portions 424 formed on a top side and a bottom side of the second retainer 420. As clearly understood from FIG. 8, the connect portions 302 of the contacts C21 to C24 of the second contact set 320 are arranged in a common row, i.e. a second connect row RC2 as shown in FIG. 14. The terminal portions 304 of the signal contacts C22 and C23 are arranged in the first terminal row RT1, while the terminal portions 304 of the ground contact C21 and the power contact C24 are arranged in the second terminal row RT2, as shown in FIG. 15. In other words, the terminal portions 304 of the signal contacts C22 and C23 and the terminal portions 304 of the ground contact C21 and the power contact C24 are arranged in different rows.

As shown in FIG. 7, the positioning portions 424 are depressions. The positioning portions 424 of the second assembly 220 are mated with the positioning portions 414 of the first assembly 210 so that the second assembly 220 is stacked on the first assembly 210 correctly in place.

As understood from FIGS. 5 and 7, when the second assembly 220 is stacked on the first assembly 210, the connect portions 302 of the contacts C21 to C24 of the second assembly 220 are partially positioned in the corresponding grooves 413 of the base portion 412 of the first assembly 210 so that each of the contact portions 303 of the contacts C21 to C24 are positioned out of the grooves 413 in the Z-direction. The contact portions 303 of the contacts C21 to C24 of the second contact set 320 are positioned at the back of the contact portions 303 of the contacts C11 to C15 of the first contact set 310 in the Y-direction. In other words, the contact portions 303 of the contacts C21 to C24 are arranged farther from the front portion of the connector 100 than the contact portions 303 of the contacts C11 to C15 in the Y-direction.

As explained above, the connect portion 302 of the ground contact C13 of the first contact set 310 has the narrow part 306 as shown in FIG. 6. As understood from FIGS. 5 to 7 and 15, the narrow part 306 allows the terminal portions 304 of the signal contacts C22 and C23 of the second contact set 320 to be arranged in the common terminal row, i.e. the first terminal row RT1, without contacting the ground contact C13 of the first contact set 310. In other words, the narrow part 306 allows the terminal portions of the signal contacts C22 and C23 to pass through the notches of the narrow part 306.

Figure 9:
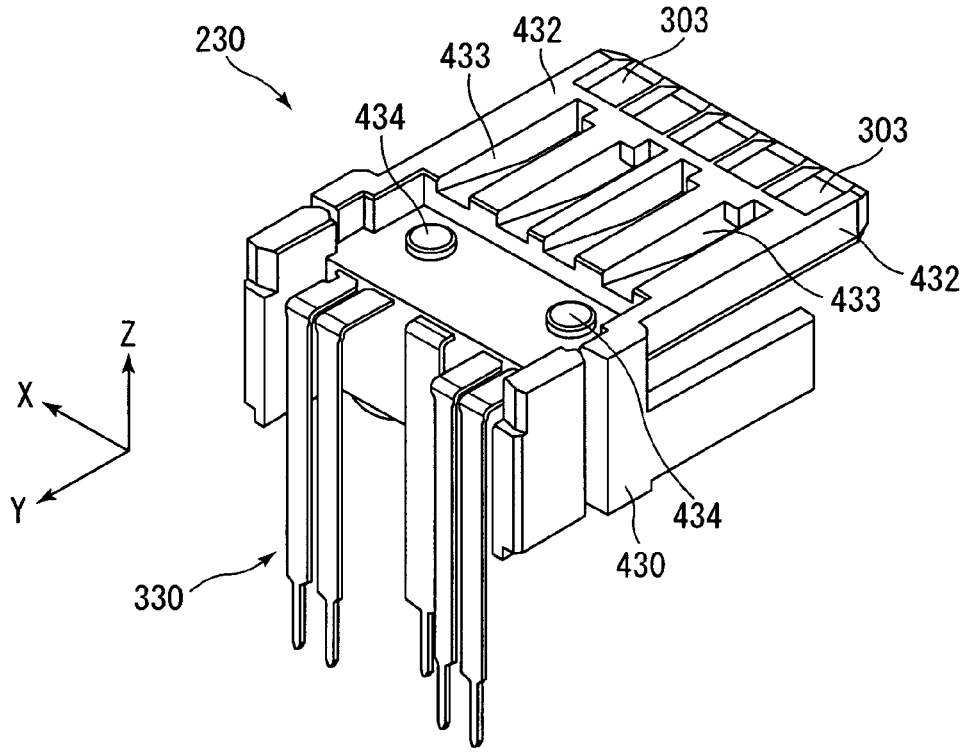
FIG. 9 is an oblique view showing a third assembly included in the connector FIG. 1.
Figure 10:
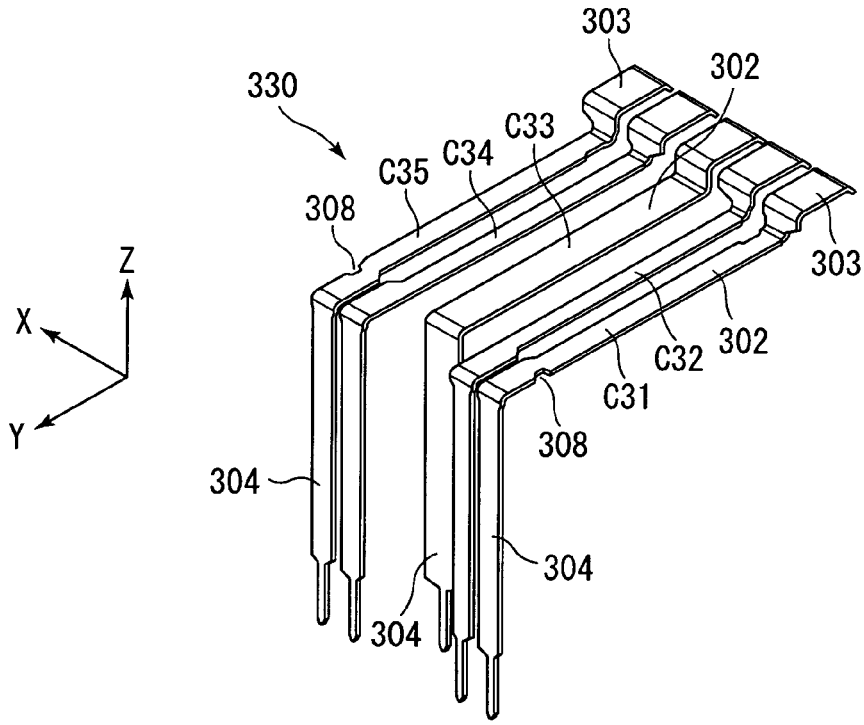
FIG. 10 is an oblique view showing a third contact set included in the third assembly of FIG. 9.

With reference to FIGS. 9 and 10, the third assembly 230 comprises a third contact set 330 and a third retainer 430 retaining the third contact set 330. The third retainer 430 is formed of an insulator.

With reference to FIG. 10, the third contact set 330 comprises five contacts C 31 to C35 required for only the USB 3.0 connection. The contacts C31, C32, C34, and C35 are signal contacts. The contact C33 is a ground contact. The contacts C31 and C32 constitute a signal contact pair. The contacts C34 and C35 constitute another signal contact pair. The ground contact C33 is arranged between the signal contact pair C31 and C32 and the signal contact pair C34 and C35 in the X-direction. Similarly to the first contact set 310 as shown in FIG. 6, each of the contacts C31 to C35 has the terminal portion 304 and the connect portion 302 having the contact portion 303.

The connect portions 302 of the signal contacts C31 and C35 have two narrow parts 308, respectively. Each of the narrow parts 308 is formed with a notch (a rectangular cut) in the outer edge in the X-direction of the connect portion 302. As shown in FIGS. 9 and 10, the narrow parts 308 and the terminal portions 304 of the ground contact C33 are arranged in the same position along the Y-direction. In other words, when seen along the Z-direction, the narrow parts 308 and the terminal portions 304 of the ground contact C33 are arranged in a straight line extending along the X-direction.

With reference to FIGS. 9 and 10, the third retainer 430 comprises a base portion 432 having a plate-like shape, four grooves 433 formed on the base portion 432 and positioning portions 434 formed on a top side and a bottom side of the base portion 432. The base portion 432 has a front end in the Y-direction. The base portion 432 retains the connect portions 302 of the contacts C31 to C35 so that the contact portions 303 of the connect portions 302 are arranged close to the front end of the base portion 432. As clearly understood from FIG. 10, the connect portions 302 of the contacts C31 to C35 of the third contact set 330 are arranged in a common row, i.e. a third connect row RC3 as shown in FIG. 14. The terminal portions 304 of the signal contacts C31, C32, C34 and C35 are arranged in a third terminal row RT3, while the terminal portion 304 of the ground contact C33 is arranged in the second terminal row RT2, as shown in FIG. 15. In other words, the terminal portions 304 of the signal contacts C31, C32, C34 and C35 and the terminal portion 304 of the ground contact C33 are arranged in different rows.

As shown in FIG. 9, the positioning portions 434 protrude from the base portion 432. The positioning portions 434 of the third assembly 230 are mated with the positioning portions 424 of the second assembly 220 so that the third assembly 230 is stacked on the second assembly 220.

As understood from FIGS. 5 and 9, the ground contact C13 of the first contact set 310 and the ground contact C33 of the third contact set 330 are arranged to be close to each other or brought into contact with each other so as to be connected to a common connect portion of the circuit board.

Figure 11:
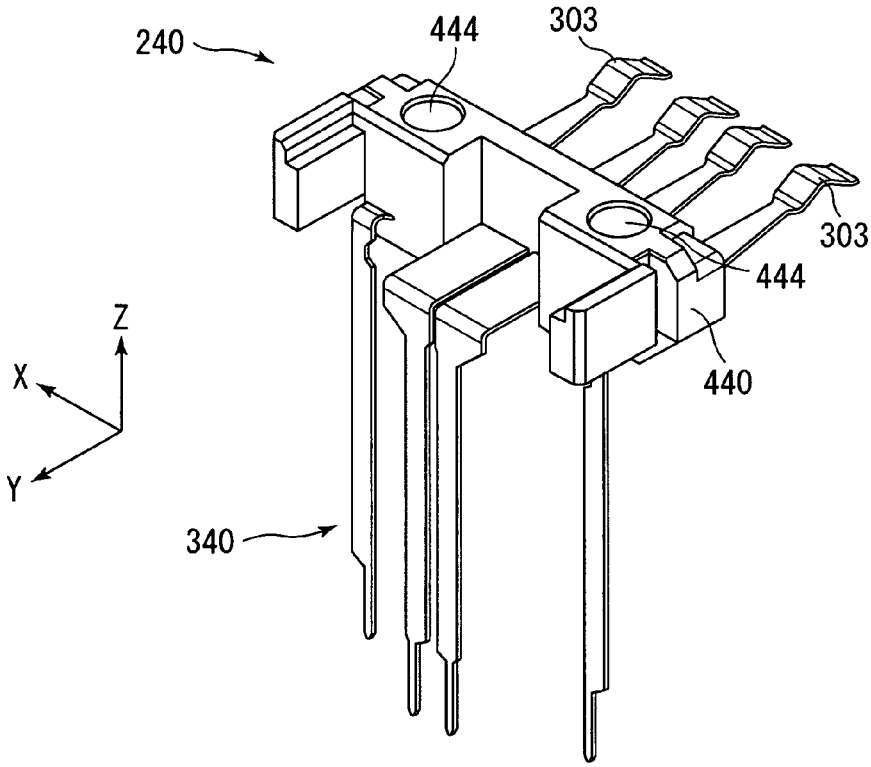
FIG. 11 is an oblique view showing a fourth assembly included in the connector of FIG. 1.
Figure 12:
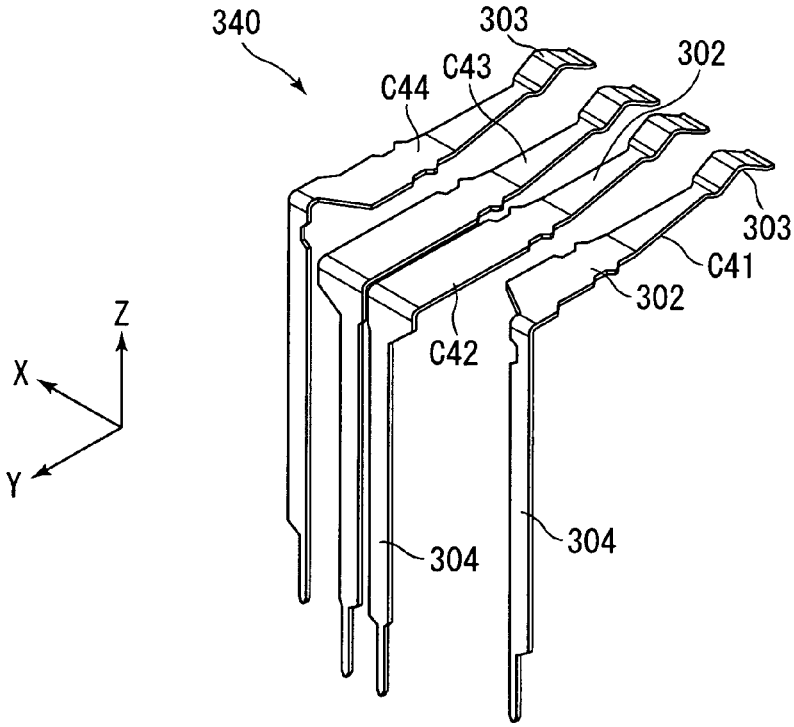
FIG. 12 is an oblique view showing a fourth contact set included in the fourth assembly of FIG. 11.
Figure 13:
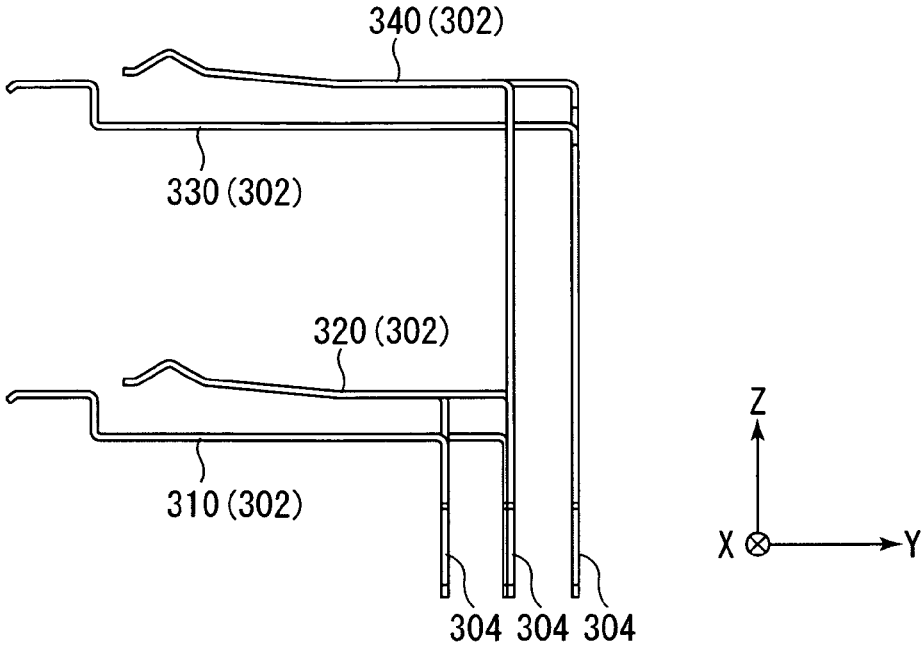
FIG. 13 is a side view showing an arrangement of the first contact set to the fourth contact set of FIGS. 6, 8, 10 and 12, respectively.

With reference to FIGS. 11 and 12, the fourth assembly 240 comprises a fourth contact set 340 and a fourth retainer 440 retaining the forth contact set 340. The fourth retainer 440 is formed of an insulator.

With reference to FIG. 12, the fourth contact set 340 comprises four contacts C41 to C44 used for both USB 2.0 connection and USB 3.0 connection. The contacts C42 and C43 are signal contacts and constitute a signal contact pair. The contact C41 is a ground contact C41. The contact C44 is a power contact C44. The signal contact pair C42 and C43 is arranged between the ground contact C41 and the power contact C44 in the X-direction. Similarly to the first contact set 310 as shown in FIG. 6, each of the contacts C41 to C44 has the terminal portion 304 and the connect portion 302 having the contact portion 303.

With reference to FIGS. 11 and 12, the fourth retainer 440 comprises positioning portions 444 formed on a top side and a bottom side (not shown) of the fourth retainer 440. As clearly understood from FIG. 12, the connect portions 302 of the contacts C41 to C44 of the fourth contact set 340 are arranged in a common row, i.e. a fourth connect row RC4 as shown in FIG. 14. The terminal portions 304 of the signal contacts C42 and C43 are arranged in the third terminal row RT3, while the terminal portions 304 of the ground contact C41 and the power contact C44 are arranged in the second terminal row RT2, as shown in FIG. 15. In other words, the terminal portions 304 of the signal contacts C42 and C43 and the terminal portions 304 of the ground contact C41 and the power contact C44 are arranged in different rows.

As shown in FIG. 11, the positioning portions 444 are depression. The positioning portions 444 of the fourth assembly 240 are mated with the positioning portions 434 of the third assembly 230 so that the fourth assembly 240 is stacked on the third assembly 230 correctly in place.

As understood from FIGS. 9 and 11, when the fourth assembly 240 is stacked on the third assembly 230, the connect portions 302 of the contacts C41 to C44 of the fourth assembly 240 are partially positioned in the corresponding grooves 433 of the base portion 432 of the third assembly 230 so that each of the contact portions 303 of the contacts C41 to C44 are positioned out of the grooves 433 in the Z-direction. The contact portions 303 of the contacts C41 to C44 of the fourth contact set 340 are positioned at the back of the contact portion 303 of the contacts C31 to C35 of the third contact set 330. In other words, contact portions 303 of the contacts C41 to C44 are arranged farther from the front portion of the connector 100 than the contact portions 303 of the contacts C31 to C35 in the Y-direction.

As explained above, the connect portions 302 of the signal contacts C31 and C35 of the third contact set 330 have the narrow parts 308. As understood from FIGS. 9, 11 and 15, the narrow parts 308 allow the terminal portions 304 of the ground contact C41 and the power contact C44 of the fourth contact set 340 to be arranged in the common terminal row, i.e. the second terminal row RT2, without contacting the signal contacts C31 and C35 of the third contact set 330, respectively. In other words, the narrow parts 308 allow the terminal portions 304 of the signal contacts C41 and C44 to pass through the respective notches of the narrow parts 308 of the signal contacts C31 and C35.

With reference to FIGS. 14 and 15, each of the first connect row RC1 to the fourth connect row RC4 and the first terminal row RT1 to the third terminal row RT3 are extending along the X-direction. As shown in FIG. 15, the terminal portions 304 are arranged in zigzag manner when viewing along the Z-direction. The second terminal row RT2 consists of: the power contacts C24 and C44; and the ground contacts C13, C21, C33 and C41, i.e. the second terminal row RT2 of the embodiment doesn't comprise the signal contacts.

With reference to FIGS. 14 and 15, the number of the terminal rows RT1 to RT3 is smaller than the number of the connect rows RC1 to RC4. Thus, a size of the footprint of the connector 100 can be reduced.

Two terminal portions which constitute one signal contact pair are arranged in a common terminal row. Thus, a signal transmission quality of the connector 100 can be better than that of a connector which comprises the two terminal portions arranged in different rows.

The terminal portions 304 of the signal contacts are arranged in outer row RT1 or RT3 extending along the X-direction. Thus, a wiring pattern on the circuit board can be simplified and easily designed.

As understood from FIGS. 14 and 15, a distance between the terminal portions 304 of the signal contact pair C11 and C12 and the terminal portions 304 of the signal contact pair C14 and C15 are longer than a distance between the connect portions 302 of the signal contact pair C11 and C12 and the connect portions 302 of the signal contact pair C14 and C15.

Thus, a cross talk (signal interference) between the signal contact pair C11 and C12 and the signal contact pair C14 and C15 can be reduced. Similarly, a distance between the terminal portions 304 of the signal contact pair C31 and C32 and the terminal portions 304 of the signal contact pair C34 and C35 are longer than a distance between the connect portions 302 of the signal contact pair C31 and C32 and the connect portions 302 of the signal contact pair C34 and C35. Thus, a cross talk between the signal contact pair C31 and C32 and the signal contact pair C34 and C35 can be reduced.

The terminal portions 304 of the signal contacts of the socket 102 and the terminal portions 304 of the signal contacts of the socket 104 are arranged in different terminal rows RT1 and RT3. A cross talk between the terminal portions 304 of the signal contacts of the socket 102 and the terminal portions 304 of the signal contacts of the socket 104 can be prevented.

With reference to FIGS. 1, 2, 5, 7, 9 and 11, the first retainer 410 to the fourth retainer 440 are stacked in numeral order along the Z-direction so as to form the housing 400. The housing 400 holds the first contact set 310 to the fourth contact set 340. In other words, the housing 400 comprises the first retainer 410 to the fourth retainer 440. However, some members of the housing 400 or all members of the housing 400 may be formed integrally with each other. A part of the first contact set 310 to the fourth contact set 340 or all of the first contact set 310 to the fourth contact set 340 may be formed by an insert-molding process.

With reference to FIGS. 1, 2 and 16 to 18, the shell 500 comprises a first shell 510, a second shell 520 and a third shell 530.

Figure 16:
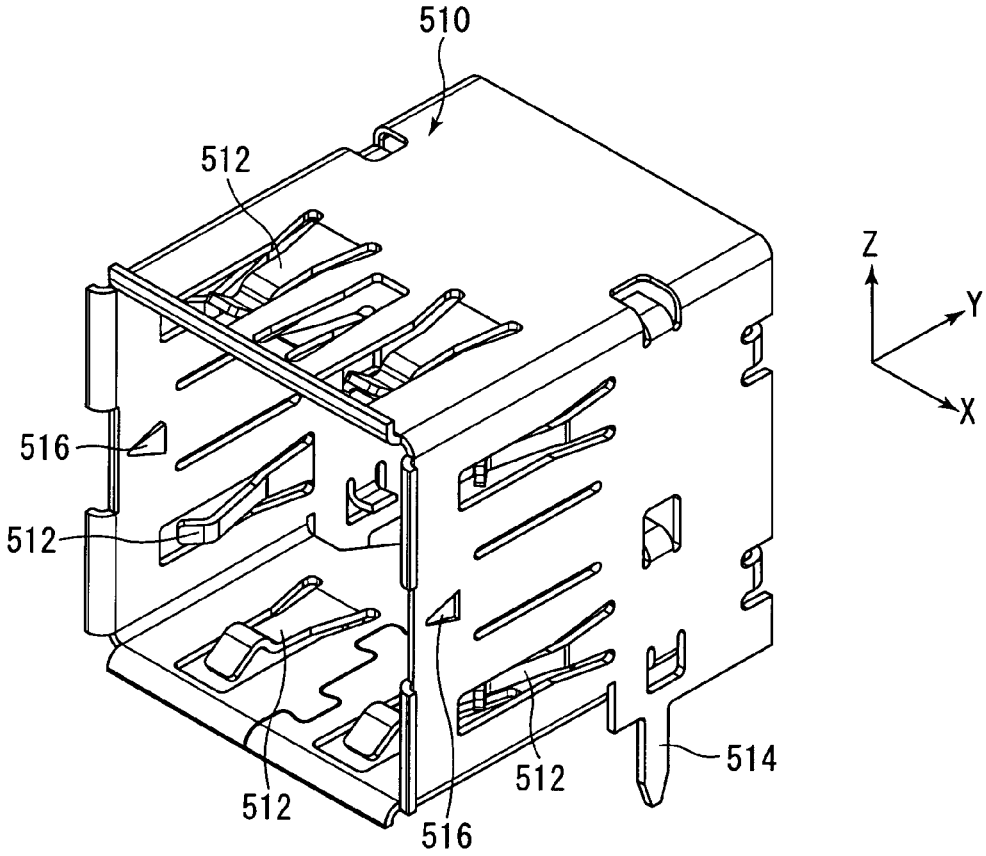
FIG. 16 is an oblique view showing a first shell portion of the connector of FIG. 1.

With reference to FIG. 16, the first shell 510 has a top portion, two side portions and a bottom portion so that the first shell 510 has an rectangular cylinder-like shape. The first shell 510 covers the structure 200 along the X-direction and the Z-direction. The first shell 510 comprises spring portions 512, connect posts 514 and projections 516. The spring portions 512 are formed on the top portion, the side portions and the bottom portion of the first shell 510 and are configured to be contact with a shell of the mating plug connector. The connect post 514 extends from bottom edge of the side portion along the Z-direction. The connect post 514 is configured to be connected and fixed to the circuit board. The projections 516 are formed on inner surfaces of the side portions of the first shell 510 and project inwardly along the X-direction.

Figure 17:
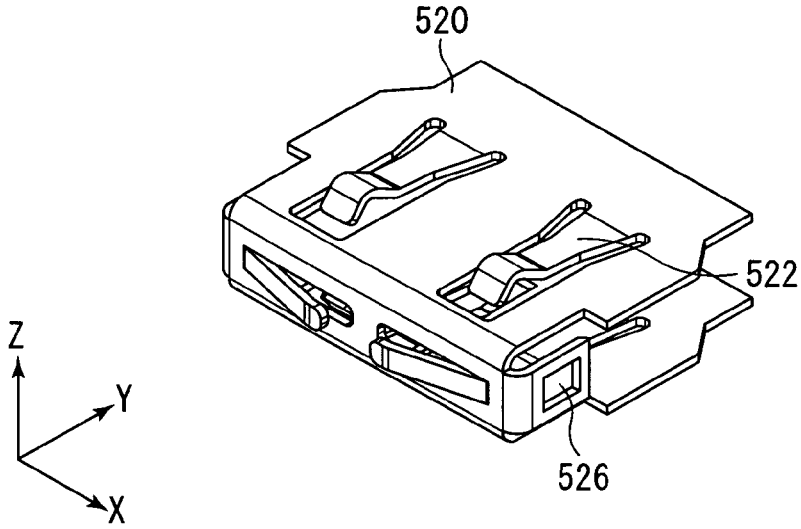
FIG. 17 is an oblique view showing a second shell portion of the connector of FIG. 1.

With reference to FIGS. 1 and 17, the second shell 520 comprises a top portion, a front portion, a bottom portion and two tabs extending from the front portion. Each of the top portion and the bottom portion is formed with two spring portions 522. Each of the tabs is formed with a hole 526. With reference to FIGS. 1 and 2, the second shell 520 is attached to the first shell 510. In detail, the second shell 520 is inserted into the first shell 510 from the front of the first shell 510 along the Y-direction so that the projections 516 are positioned in the holes 526. The second shell 520 is attached and fixed to the first shell 510.

Figure 4:
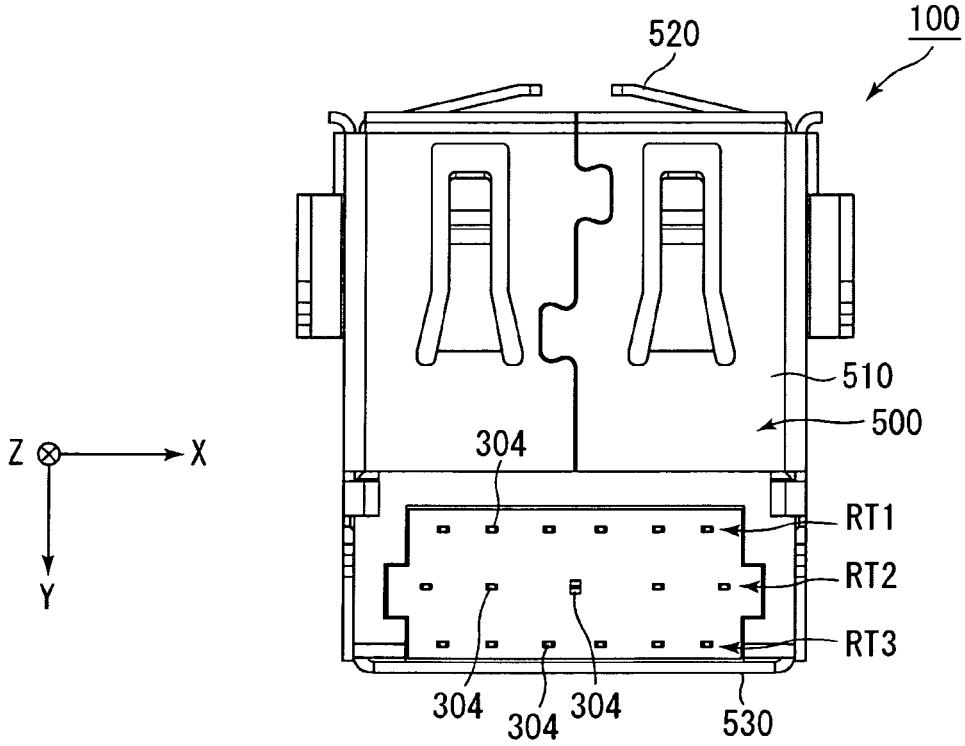
FIG. 4 is a bottom view showing the connector of FIG. 1.
Figure 18:
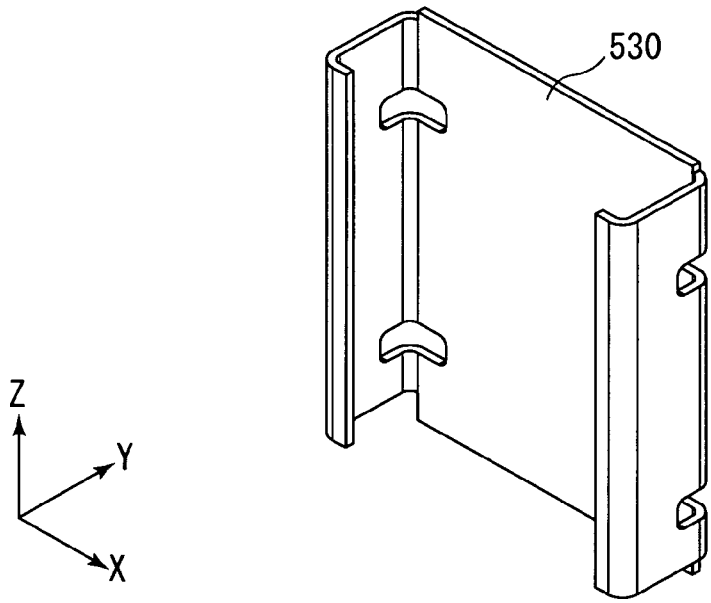
FIG. 18 is an oblique view showing a third shell portion of the connector of FIG. 1.

With reference to FIGS. 4 and 18, the third shell 530 covers the structure 200 in the Y-direction and holds the structure 200. The stacked retainers 210 to 240 are attached to the third shell 530 so that the retainers 410 to 440 are provisionally held by the third shell 530.

The connector 100 of the embodiment is assembled by: attaching the structure 200 to the third shell 530; inserting the structure 200 and the third shell 530 into the first shell 510 from the back of the first shell 510 along Y-direction; and attaching the second shell 520 into the first shell 510 from the front of the first shell 510 along Y-direction.

Figure 19:
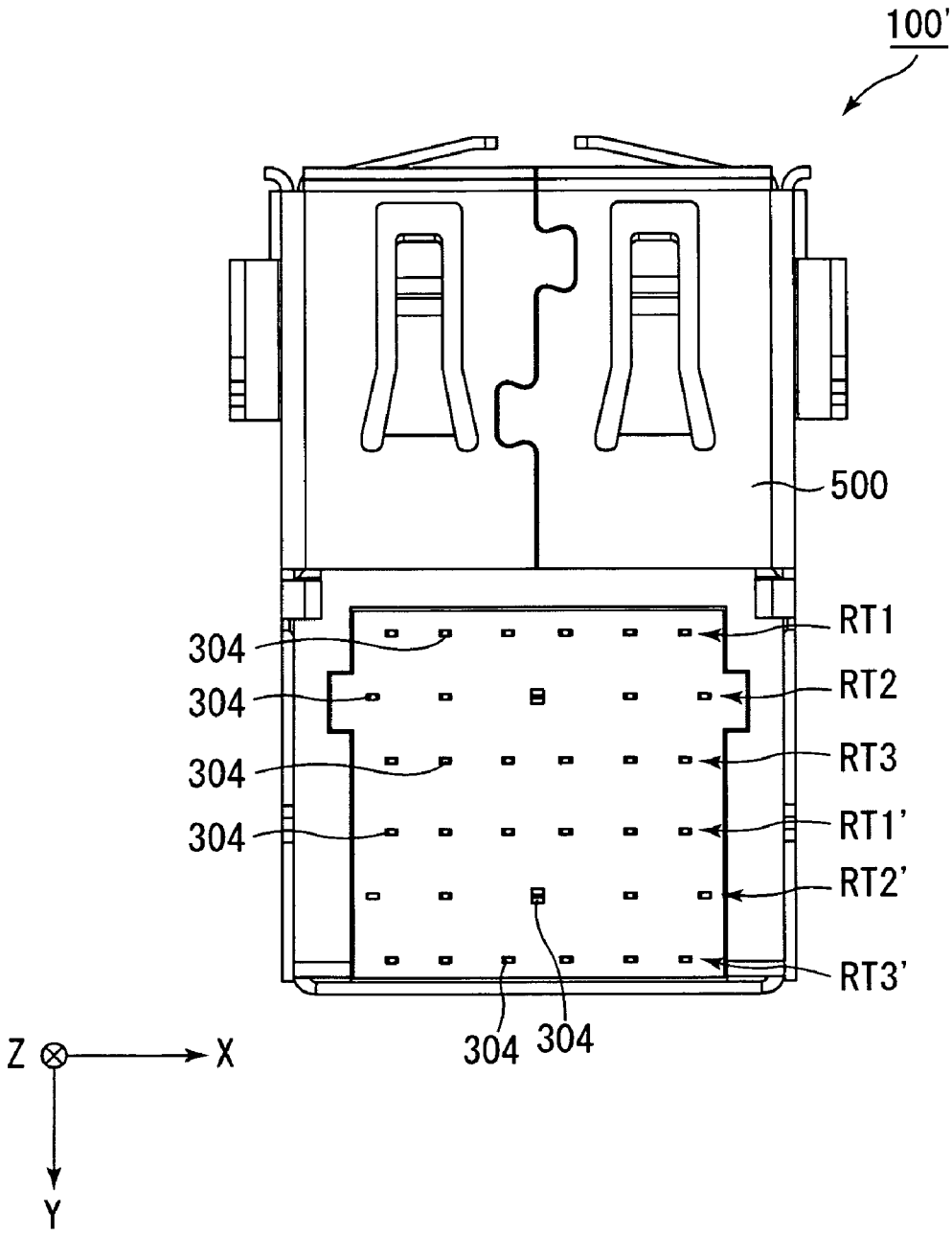
FIG. 19 is a bottom view showing a connector according to another embodiment of the present invention.

The connector 100 of the present invention may comprise more than two sockets. For example, with reference to FIG. 19, the connector 100' comprises four sockets (not shown). In FIG. 19, the first terminal row RT1' to the third terminal row RT3' are arranged in like manner of the first terminal row RT1 to the third terminal row RT3, respectively. The arrangement of the contacts of the connector 100' can reduce a cross talk between the signal contact pairs. A number of the terminal rows RT1 to RT3, RT1' to RT3' are minimized, as compared to a number of the connect rows RC1 to RC4, RC1' to RC4' (not shown). Thus, a size of the footprint of the connector 100' can be reduced.

Each of the sockets of the connector may be turned upside down.

The present application is based on a Japanese patent application of JP2009-241269 filed before the Japan Patent Office on Oct. 20, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a housing and a first contact set to a fourth contact set held by the housing, wherein:

each of the first contact set to the fourth contact set comprises a plurality of contacts;

each of the contacts has a connect portion and a terminal portion extending from the connect portion so that the contact has an L-like shape;

the connect portion is configured to be connected to a mating connector;

the terminal portion is configured to be connected to a connection object;

the connect portions of the first contact set to the fourth contact set are arranged in first connect row to fourth connect row, respectively;

the terminal portions of the first contact set to the fourth contact set are arranged in first terminal row to third terminal row;

the contacts of the first contact set include two first signal contact pairs;

the terminal portions of one of the first signal contact pairs and the terminal portions of another one of the first signal contact pairs are arranged apart from each other in the first terminal row;

the contacts of the third contact set include two third signal contact pairs; and the terminal portions of one of the third signal contact pairs and the terminal portions of another one of the third signal contact pairs are arranged apart from each other in the third terminal row.

2. The connector according to claim 1, wherein:

at least one of the terminal portions of the contacts of the second contact set is arranged between the two first signal contact pairs in the first terminal row; and at least one of the terminal portions of the contacts of the fourth contact set is arranged between the two third signal contact pairs in the third terminal row.

3. The connector according to claim 2, wherein:

the contacts of the second contact set includes a second signal contact pair, the terminal portions of the second signal contact pair being arranged between the terminal portions of the two first signal contact pairs in the first contact row; and the contacts of the fourth contact set includes a fourth signal contact pair, the terminal portions of the fourth signal contact pair being arranged between the terminal portions of the two third signal contact pairs in the third contact row.

4. The connector according to claim 1, wherein:

the contacts of the first contact set to the forth contact set include power contacts and ground contacts; and the second terminal row arranged between the first terminal row and the third terminal row consists of the terminal portions of the power contacts and the ground contacts, the terminal portions of the power contacts, or the terminal portions of the ground contacts.

5. The connector according to claim 1, wherein one of the terminal portions of the contacts of the first contact set and one of the terminal portions of the contacts of the third contact set are arranged in the second terminal row and are brought into contact with each other so as to be connected to a common connect portion of the connection object.

6. The connector according to claim 1, wherein:

the housing comprises a first retainer to a fourth retainer, which retain the first contact set to the fourth contact set, respectively;

the terminal portions extend in a predetermined direction; and the first retainer to the fourth retainer are stacked in numerical order along the predetermined direction.

7. The connector according to the claim 6, wherein:

the first contact set consists of the two first signal contact pairs and a first ground contact arranged between the two first signal contact pairs, the terminal portions of the contacts of the first signal contact pairs being arranged in the first terminal row, the terminal portion of the first ground contact being arranged in the second terminal row;

the second contact set consists of a second signal contact pair, a second ground contact and a first power contact, the second signal contact pair being arranged between the second ground contact and the first power contact, the terminal portions of the second signal contact pair being arranged in the first terminal row, the terminal portion of the ground contact and the terminal portion of the power contact being arranged in the second terminal row;

the third contact set consists of the two third signal contact pairs and a third ground contact arranged between the two third signal contact pairs, the terminal portions of the third signal contact pairs being arranged in the third terminal row, the terminal portion of the third ground contact being arranged in the second terminal row; and the fourth contact set consists of a fourth signal contact pair, a fourth ground contact and a second power contact, the fourth signal contact pair being arranged between the fourth ground contact and the second power contact, the terminal portions of the fourth signal contact pair being arranged in the third terminal row, the terminal portion of the fourth ground contact and the terminal portion of the second power contact being arranged in the second terminal row.

8. The connector according to claim 7, wherein the connect portion of the first ground contact has a narrow part so as to allow the terminal portions of the second signal contact pair to be arranged in the first terminal row.

* * * * *